US010186230B2

(12) United States Patent
Xue et al.

(10) Patent No.: US 10,186,230 B2
(45) Date of Patent: Jan. 22, 2019

(54) SHIFT REGISTER, GATE DRIVING CIRCUIT AND DRIVING METHOD THEREOF, DISPLAY PANEL

(71) Applicants: BOE TECHNOLOGY GROUP CO., LTD., Beijing (CN); HEFEI BOE OPTOELECTRONICS TECHNOLOGY CO.,LTD., Hefei (CN)

(72) Inventors: Wei Xue, Beijing (CN); Hongmin Li, Beijing (CN); Zhifu Dong, Beijing (CN); Ping Song, Beijing (CN); Bo Liu, Beijing (CN)

(73) Assignees: BOE TECHNOLOGY GROUP CO., LTD., Beijing (CN); HEFEI BOE OPTOELECTRONICS TECHNOLOGY CO., LTD., Hefei (CN)

( * ) Notice: Subject to any disclaimer, the term of this patent is extended or adjusted under 35 U.S.C. 154(b) by 562 days.

(21) Appl. No.: 14/862,670

(22) Filed: Sep. 23, 2015

(65) Prior Publication Data

US 2016/0275902 A1 Sep. 22, 2016

(30) Foreign Application Priority Data

Mar. 18, 2015 (CN) ..... 2015 1 0119295

(51) Int. Cl.

| | |
|---|---|
| ***G09G 3/20*** | (2006.01) |
| ***G09G 5/00*** | (2006.01) |
| ***G09G 3/3266*** | (2016.01) |
| ***G09G 3/36*** | (2006.01) |

(52) U.S. Cl.

CPC ..... *G09G 5/003* (2013.01); *G09G 3/20* (2013.01); *G09G 3/3266* (2013.01);

(Continued)

(58) Field of Classification Search

CPC ..... G09G 5/003; G09G 2310/0286; G09G 2310/0289; G09G 2300/0426

See application file for complete search history.

(56) References Cited

U.S. PATENT DOCUMENTS

2004/0217935 A1* 11/2004 Jeon ..... G09G 3/3648 345/100
2007/0070021 A1 3/2007 Ahin et al.
2008/0219401 A1* 9/2008 Tobita ..... G09G 3/3677 377/79
2009/0251443 A1* 10/2009 Jinta ..... G09G 3/3233 345/204

(Continued)

FOREIGN PATENT DOCUMENTS

CN 101937718 A 1/2011
CN 102629444 A 8/2012

(Continued)

OTHER PUBLICATIONS

Office Action in Chinese Application No. 201510119295.9 dated Jul. 5, 2017, with English translation.

(Continued)

*Primary Examiner* — Carolyn R Edwards
(74) *Attorney, Agent, or Firm* — Womble Bond Dickinson (US) LLP

(57) ABSTRACT

The present disclosure provides a shift register, comprising: a first input module, a second input module, an energy storage module, an output module and a reset module; and two shift signal input terminals, a reset control signal input terminal, a second electrical level input terminal and a first electrical level input terminal; a control terminal and an input terminal of the first input module being connected with the first shift signal input terminal, a control terminal and an input terminal of the second input module being connected with the second shift signal input terminal; output terminals (Continued)

of the first input module and the second input module as well as a first terminal of the energy storage module all being connected with a first node; the first input module and the second input module being configured to be turned on when the first or second shift signal input terminal accesses a first electrical level, and set the voltage of the first node to the first electrical level. In a gate scanning circuit utilizing the shift register provided by the present disclosure, it is unnecessary to arrange VSS signal lines and VDD signal lines, which can reduce the area occupied by the corresponding gate driving circuit, and is favorable for narrowing down the frame of display panels.

18 Claims, 6 Drawing Sheets

(52) U.S. Cl.
CPC ... *G09G 3/3674* (2013.01); *G09G 2300/0426* (2013.01); *G09G 2310/0267* (2013.01); *G09G 2310/0283* (2013.01); *G09G 2310/0286* (2013.01); *G09G 2310/0289* (2013.01); *G09G 2310/061* (2013.01); *G09G 2310/08* (2013.01)

(56) References Cited

U.S. PATENT DOCUMENTS

| | | | | |
|---|---|---|---|---|
| 2011/0116592 | A1* | 5/2011 | Tsai | G11C 19/184 377/79 |
| 2013/0088265 | A1* | 4/2013 | Chen | H03K 5/153 327/108 |
| 2014/0098015 | A1 | 4/2014 | Wang | |

FOREIGN PATENT DOCUMENTS

| | | | |
|---|---|---|---|
| CN | 102956213 | A | 3/2013 |
| CN | 202905121 | U | 4/2013 |
| CN | 103426414 | A | 12/2013 |
| CN | 103606359 | A | 2/2014 |
| CN | 103680636 | A | 3/2014 |

OTHER PUBLICATIONS

Office Action in Chinese Application No. 201510119295.9 dated Jul. 6, 2016, with English translation. 10 pages.
Chinese Office Action with English Language Translation, dated Dec. 28, 2016, Chinese Application No. 201510119295.9.

* cited by examiner

SHIFT REGISTER, GATE DRIVING CIRCUIT AND DRIVING METHOD THEREOF, DISPLAY PANEL

RELATED APPLICATIONS

The present application claims the benefit of Chinese Patent Application No. 201510119295.9, filed on Mar. 18, 2015, the entire disclosure of which is incorporated herein by reference.

FIELD

The present disclosure relates to the field of display technology, particularly to a shift register, a gate driving circuit and a driving method thereof, a display panel.

BACKGROUND

The driving circuit of liquid crystal displays mainly includes a gate driving circuit and a data driving circuit, wherein the data driving circuit latches the inputted display data timely and orderly, and inputs it to the data line of the liquid crystal panel after converting it into an analog signal; the gate driving circuit converts the inputted clock signal into a turn-on/turn-off voltage via SR (Shift Register) conversion, which turn-on/turn-off voltage is applied onto the gate lines of the liquid crystal panel in sequence. In addition, the shift register in the gate driving circuit is also used for generating a scanning signal in the scanning gate line.

In order to meet the requirement of bidirectional scanning, some bidirectional scanning gate driving circuits are proposed in the prior art. these bidirectional scanning gate driving circuits generally include multi-stage of shift registers, each shift register S/R(n) ($1 \leq n \leq N$) outputs the scanning signal to a corresponding gate line G(n) through its own output signal output terminal OutPut, and outputs the scanning signal to the reset signal input terminal RESET of the S/R(n−1) and the signal input terminal InPut of the S/R(n+1). The scanning signal plays the functions of resetting and starting to the S/R(n−1) and the S/R(n+1) respectively, wherein S/R(1) inputs a frame start signal STV through its own signal input terminal. The basic principles of the shift registers in these gate driving circuits are all consistent, referring to FIG. 2, which is a structural schematic view of a typical shift register in the bidirectional scanning gate driving circuit. The input part thereof includes two transistors M1 and M2, wherein the gate of M1 is connected with the INPUT (i.e., G(n−1)), the source is connected with the VDD; the gate of M2 is connected with the RESET (i.e., G(n+1)), the source is connected with the VSS; thus in forward scanning, the VDD terminal is inputted with a high electrical level, the VSS terminal is inputted with a low electrical level, the high electrical level pulse of the G(n−1) turns on the transistor M1, to realize charging of the PU point; the high electrical level pulse of the G(n+1) turns on the transistor M2, to realize reset of the PU point; while in backward scanning, the VDD terminal is inputted with a low electrical level, the VSS terminal is inputted with a high electrical level; the high electrical level pulse of the RESET (G(n+1)) turns on the transistor M2, to realize charging of the PU point, the high electrical level pulse of the INPUT (G(n−1)) turns on the transistor M2, to realize reset of the PU point. In this way, backward scanning of the corresponding gate driving circuit can be realized by converting the access voltages of the VDD terminal and the VSS terminal. However, VSS signal lines and VDD signal lines need to be arranged in the gate driving circuit constituted by such shift registers, which increases the layout area of the gate driving circuit, and is unfavorable for narrowing down the frame of the display panel.

SUMMARY

An object of the present disclosure is to provide a shift register, so as to reduce the layout area of the corresponding gate driving circuit.

In the first aspect, the present disclosure provides a shift register, which may comprise: a first input module, a second input module, an energy storage module, an output module and a reset module; and two shift signal input terminals, a reset control signal input terminal, a second electrical level input terminal and a first electrical level input terminal;

a control terminal and an input terminal of the first input module being connected with a first shift signal input terminal, a control terminal and an input terminal of the second input module being connected with a second shift signal input terminal; output terminals of the first input module and the second input module as well as a first terminal of the energy storage module all being connected with a first node; the first input module and the second input module being configured to be turned on when the first or second shift signal input terminal accesses a first electrical level, and set the voltage of the first node to the first electrical level;

an output terminal of the reset module being connected with the first node, a control terminal of the reset module being connected with the reset control signal input terminal, an input terminal of the reset module being connected with the second electrical level input terminal, the reset module being configured to be turned on in response to a control signal accessed by the reset control signal input terminal, and set the voltage of the first node to a second electrical level capable of turning off the output module;

a control terminal of the output module being connected with the first node, an output terminal of the output module being connected with a shift signal output terminal, an input terminal of the output module being connected with the first electrical level input terminal, the output module being configured to be turned on when a voltage of the first node is the first electrical level, and output a shift signal of the first electrical level.

According to some embodiments, the shift register may further comprise an unset module; an output terminal of the unset module being connected with the shift signal output terminal, an input terminal of the unset module being connected with the second electrical level input terminal, the unset module being configured to be turned on under the control of the control signal accessed by the control terminal, and set a voltage of the shift signal output terminal to the second electrical level.

According to some embodiments, the reset module may comprise: a first transistor, a second transistor, a third transistor, a fourth transistor and a fifth transistor; a first electrode and a gate of the first transistor are both connected with the reset control signal input terminal; a second electrode of the first transistor, a gate of the second transistor, and a first electrode of the fourth transistor are all connected with the second node; a second electrode of the second transistor, a first electrode of the third transistor, and a gate of the fifth transistor are all connected with a third node; second electrodes of the third transistor, the fourth transistor and the fifth transistor are all connected with the second electrical level input terminal; a gate of the third transistor and a first electrode of the fifth transistor are both connected with the first node, and turn-on electrical levels of the respective transistors are consistent; a channel width to length ratio of the fourth transistor is smaller than a channel width to length ratio of the first transistor, wherein the first electrode and the second electrode of respective transistors are selected from the drain and the source of respective transistor, and the first electrode is different from the second electrode.

As known to the skilled person in the art, in the gate driving circuit, it is unnecessary to distinguish between the source and the drain of a transistor. Hence, the first electrode of the above transistor may refer to source as well as drain, and the second electrode may also refer to drain as well as drain, as long as the first electrode is different from the second electrode.

According to some embodiments, the control terminal of the unset module may be connected with the third node, and the turn-on electrical level the unset module is consistent with the turn-on electrical levels of the first transistor, the second transistor, the third transistor, the fourth transistor and the fifth transistor.

According to some embodiments, the shift register may further comprise an unset enhancing module, a control terminal of the unset enhancing module being connected with the reset control signal input terminal, an output terminal of the unset enhancing module being connected with the shift signal output terminal, an input terminal of the unset enhancing module being connected with the second electrical level input terminal, the unset enhancing module being configured to be turned on when the reset module is turned on, and set a voltage of the shift signal output terminal to the second electrical level.

According to some embodiments, the shift register may further comprise: a reset enhancing module and a reset enhancing control signal input terminal, an output terminal of the reset enhancing module being connected with the first node, an input terminal of the reset enhancing to module being connected with the second electrical level input terminal, a control terminal of the reset enhancing module being connected with the reset enhancing control signal input terminal, the reset enhancing module being configured to be turned on under the control of the control signal accessed by the reset enhancing control signal input terminal, and set a voltage of the first node to the second electrical level.

According to some embodiments, the first input module, the second input module, the output module, the reset enhancing module, the unset module and the unset enhancing module all contain transistors; and the respective transistors contained in the shift register are all N-type transistors.

In the second aspect, the present disclosure provides a gate driving circuit, which may comprise a plurality of shift registers as claimed in any one of the above, and may further comprise: a first signal line, a second signal line, a third signal line;

wherein a first shift signal input terminal of a first stage of shift register and a second shift signal input terminal of a last stage of shift register are connected with the first signal line; reset control signal input terminals of odd stages of shift registers are connected with the second signal line, reset control signal input terminals of even stages of shift registers are connected with the third signal line;

a shift signal output terminal of any stage of shift registers except for the first stage and the last stage is connected with a second shift signal input terminal of a previous stage of shift register and a first shift signal input terminal of a next stage of shift register.

According to some embodiments, when the respective shift registers are shift registers comprising a reset enhancing module and a reset enhancing control signal input terminal, a reset enhancing control signal input terminal of any stage of shift registers except for the first stage and the last stage is connected with the first signal line, and the turn-on electrical level of each reset enhancing module is the first electrical level.

In the third aspect, the present disclosure further provides a display panel, which may comprise a gate driving circuit as described above, wherein the shift registers for driving odd rows of pixels are arranged at a first side of the display area, the shift registers for driving even rows of pixels are arranged at a second side of the display area, the first side and the second side are two opposite sides.

In the fourth aspect, the present disclosure provides a method for driving a gate driving circuit as described above, which may comprise: in forward scanning, applying a start pulse with a first electrical level on the first signal line, applying a clock signal on the second signal line and the third signal line respectively; wherein the reset pulse capable of turning on the reset module in the clock signal applied on the third signal line is delayed a half pulse from the reset pulse in the clock signal applied on the second signal line; the start pulse is delayed a half pulse from the reset pulse in the clock signal applied on the second signal line; in backward scanning, applying a start pulse with a first electrical level on the first signal line, applying a clock signal on the second signal line and the third signal line respectively; wherein the reset pulse in the clock signal applied on the second signal line is delayed half pulse from the reset pulse in the clock signal applied on the third signal line; the start pulse is delayed a half pulse from the reset pulse in the clock signal applied on the third signal line.

In a gate scanning circuit utilizing the shift register provided by the present disclosure, it is unnecessary to arrange VSS signal lines and VDD signal lines, which can reduce the area occupied by the corresponding gate driving circuit, and is favorable for narrowing down the frame of the display panel.

DETAILED DESCRIPTION

In order to make the purposes, the technical solutions and the advantages of the embodiments of the present disclosure clearer, the technical solutions in the embodiments of the present disclosure will be described clearly and completely in combination with the drawings in the embodiments of the present disclosure in the following. Apparently, the described embodiments are only part of rather than all of the embodiments of the present disclosure. All the other embodiments obtained by the ordinary skilled person in the art based on the embodiments of the present disclosure without paying any creative work belong to the protection scope of the present disclosure.

Figure 1:
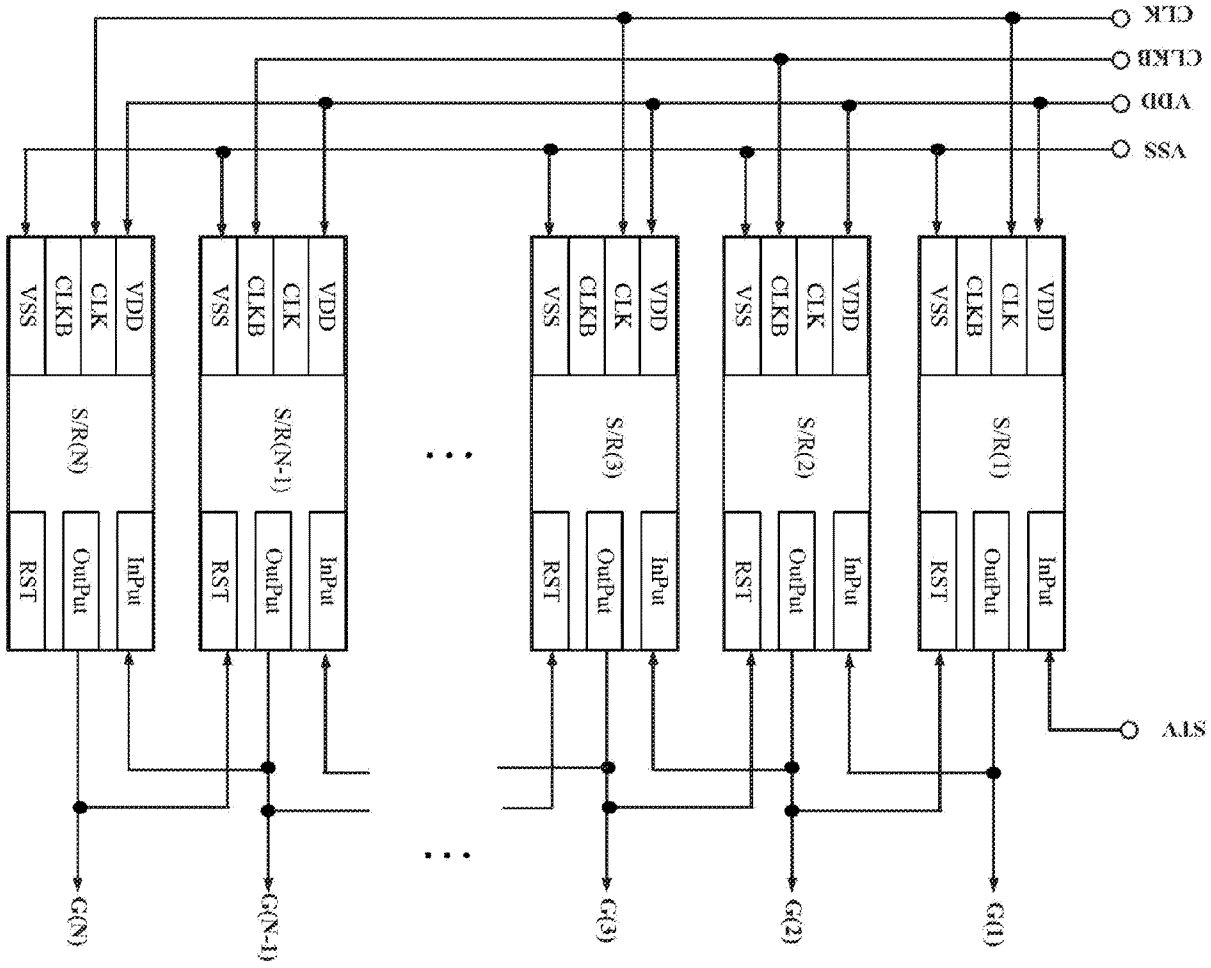
FIG. 1 is a structural schematic view of a bidirectional scanning circuit in the prior art.
Figure 2:
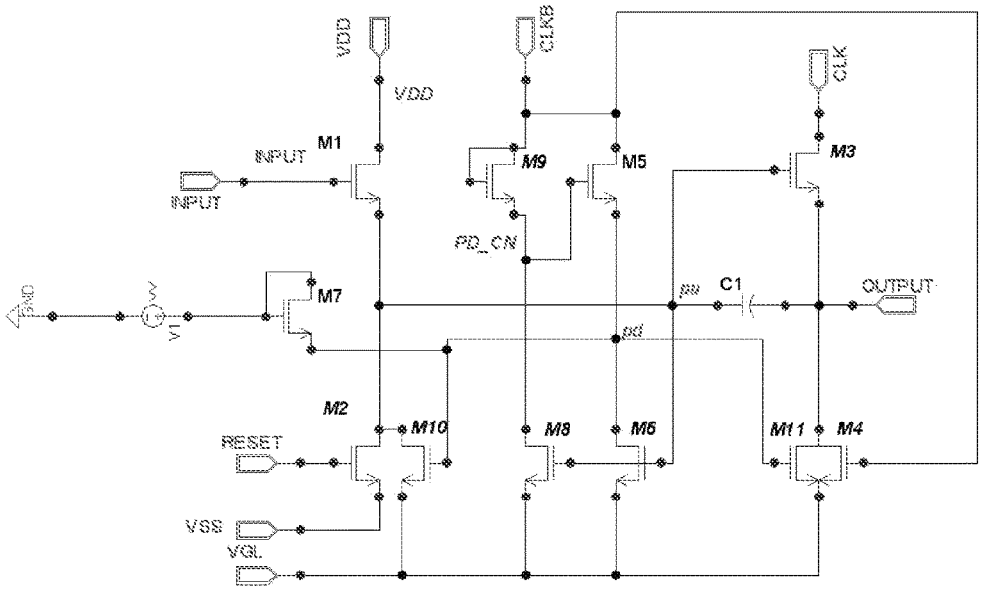
FIG. 2 is a circuit structure diagram of a shift register for use in a bidirectional scanning circuit in the prior art.
Figure 3:
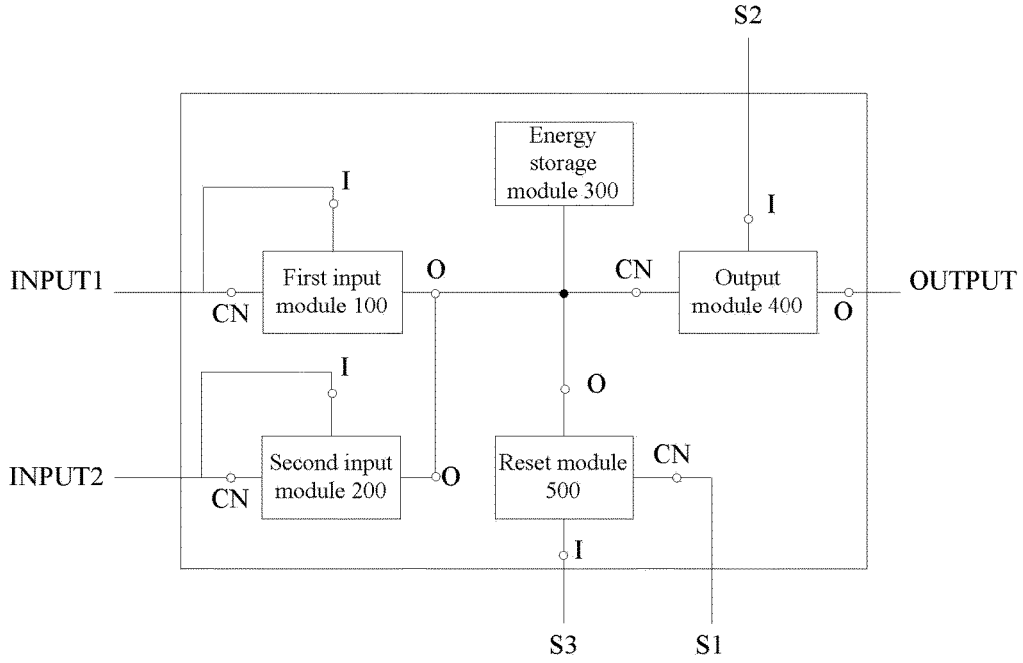
FIG. 3 is a structural schematic view of a shift register provided by an embodiment of the present disclosure.

An embodiment of the present disclosure provides a shift register, as shown in FIG. 3, the shift register comprising: a first input module 100, a second input module 200, an energy storage module 300, an output module 400 and a reset module 500, and having two shift signal input terminals INPUT1 and INPUT2, a reset control signal input terminal S1, a first electrical level input terminal S2 and a second electrical level input terminal S3; wherein a control terminal and an input terminal I of the first input module 100 (for the convenience of explanation, the input terminals of respective modules in FIG. 3 are all represented as I, the output terminals are all represented as O, the control terminals are all represented as CN) are both connected with the first shift signal input terminal INPUT1; a control terminal and an input terminal I of the second input module 200 are both connected with the second shift signal input terminal INPUT2; output terminals of the first input module 100 and the second input module 200, and a first terminal of the energy storage module are all connected with the first node PU; when the input terminal INPUT1 is at a first electrical level, the first input module 100 is turned on, and set the first node PU to the first electrical level; when the input terminal INPUT2 is at the first electrical level, the second input module 200 is turned on, and set the first node PU to the first electrical level; a control terminal of the output module 400 also is connected with the first node PU, an output terminal of the output module 400 is connected with the output terminal OUTPUT of the shift register, an input terminal of the output module 400 is connected with the first electrical level input terminal S2; the output module 400 being configured to be turned on when a voltage of the first node PU is at the first electrical level, and output a shift signal with a pulse being the first electrical level; an output terminal of the reset module 500 is connected with the first node PU, a control terminal of the reset module 500 connects to the reset control signal input terminal S1, an input terminal of the reset module 500 connects to the second electrical level input terminal S3; the reset module 500 being configured to be turned on in response to the control signal accessed by the reset control signal input terminal S1, and set the voltage of the first node PU to a second electrical level capable of turning off the output module 400.

In a gate scanning circuit utilizing the shift register provided by the present disclosure, it is unnecessary to arrange VSS signal lines and VDD signal lines, which can reduce the area occupied by the corresponding gate driving circuit, and is favorable for narrowing down the frame of the display panel.

In specific implementation, the shift register here may further comprise an unset module 600 which is not shown in the figure, an output terminal of the unset module 600 is connected with the shift signal output terminal OUTPUT, an input terminal of the unset module 600 is connected with the second electrical level input terminal S3; the unset module 600 being configured to be turned on under the control of the control signal accessed by the control terminal, and set a voltage of the shift signal output terminal OUTPUT to the second electrical level.

In this way, the voltage of the shift signal output terminal OUTPUT can be set as the second electrical level by turning on the unset module 600 after the output module 400 outputs the shift signal, so as to avoid outputting the first electrical level again.

In specific implementation, the reset module 500 here may be a single transistor (such as an N-type transistor), a first electrode (such as the drain) of the transistor is connected with the second electrical level input terminal S3, a second electrode (such as the source) is connected with the first node PU, the gate is connected with the reset control signal input terminal S1; when performing the reset, a control signal is applied on the gate of the transistor to control the transistor to be turned on, thereby the first node PU is set to the second electrical level.

Figure 4:
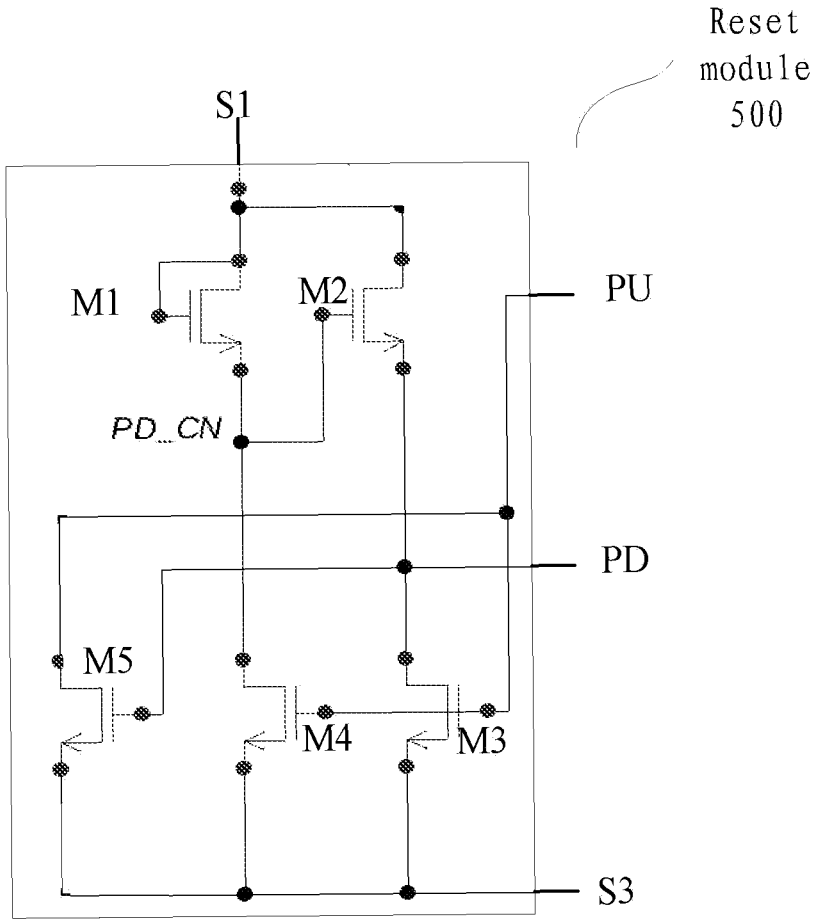
FIG. 4 is a possible circuit structure diagram of the reset module in FIG. 3.

Or, in specific implementation, above reset module 500 may also be as shown in FIG. 4, comprise five transistors M1-M5 (such as N-type transistors, as shown in FIG. 4), wherein the source and the gate of the first transistor M1 are both connected with the reset control signal input terminal S1; the drain of the first transistor M1, the gate of the second transistor M2, and the source of the fourth transistor M4 are all connected with the second node PD-CN; the drain of the second transistor M2, the source of the third transistor M3, and the gate of the fifth transistor M5 are all connected with a third node PD; the drains of the third transistor M3, the fourth transistor M4 and the fifth transistor M5 are all connected with the second electrical level input terminal S3; the gate of the third transistor M3, and the drain of the fifth transistor M5 are both connected with the first node PU, and the turn-on electrical levels of the respective transistors are consistent; the channel width to length ratio of the fourth transistor M4 is smaller than the channel width to length ratio of the first transistor M1. It should be noted that, in specific implementation, for the purpose of description, take N-type transistors as examples; however, P-type transistors can also be used, as realized by the skilled person in the art.

Here, the turn-on electrical levels of the respective transistors may be the first electrical level. Thus, in specific implementation, when performing the reset, the first electrical level may be inputted at the reset control signal input terminal S1, such that the transistor M1 is turned on. Since the channel width to length ratio of the transistor M4 is smaller than the channel width to length ratio of the transistor M1, the electrical level of the second node PD-CN keeps consistent with the electrical level of the reset control signal input terminal S1, which are both the first electrical level, such that the transistor M2 is also turned on, thereby the third node PD is also set to the first electrical level, such that the transistor M5 is turned on, thereby the first node PU and the second electrical level input terminal S3 are connected, the first node is set to the second electrical level, thus the reset process is accomplished. On the other hand, when the shift register outputs the shift signal, it is required to ensure that the first node PU is at the first electrical level, here the second electrical level may be inputted at the reset control signal input terminal, so as to turn off both of the transistors M1, M2. Since the control terminals of the transistors M3 and M4 are both connected with the first node, they will be turned on, forcing the voltages of the second node PD-CN and the third node PD to be set to the second electrical level. In this way, the gate of the transistor M5 is set to the second electrical level, so as to avoid electric leakage at the transistor M5.

In specific implementation, the control terminal of said unset module 600 may also be connected with said third node PD, here the turn-on electrical level of the unset module 600 should also be consistent with the turn-on electrical levels of the above transistors M1-M5. Thus, when the shift register outputs the shift signal, it can also be ensured that the unset module 600 will not be turned on, and the outputted shift signal will not be interfered. After the shift signal is outputted, when the first control signal input terminal S1 is inputted with the first electrical level, the unset module 600 are also turned on simultaneously, so as to realize unset of the shift signal output terminal.

In specific implementation, the shift register may further comprise an unset enhancing module 700 which is not shown in FIG. 3, a control terminal of the unset enhancing module 700 being connected with the reset control signal input terminal S1, an output terminal of the unset enhancing module 700 being connected with the shift signal output terminal OUTPUT, an input terminal of the unset enhancing module 700 being connected with the second electrical level input terminal S3; the unset enhancing module 700 being configured to be turned on when the reset module 500 is turned on, and set a voltage of the shift signal output terminal OUTPUT to the second electrical level.

Thus, the reset of the shift signal output terminal OUTPUT can be enhanced.

In specific implementation, the shift register may further comprise a reset enhancing module 800 and a reset enhancing control signal input terminal S4 which are not shown in FIG. 3, an output terminal of the reset enhancing module 800 being connected with the first node PU, an input terminal being connected with the second electrical level input terminal S3, a control terminal being connected with the reset enhancing control signal input terminal S4; the reset enhancing module 800 being configured to be turned on under the control of the control signal access by the reset enhancing control signal input terminal S4, and set a voltage of the first node PU to the second electrical level.

In specific implementation, said first input module 100, said second input module 200, said output module 400, said unset module 600 and said unset enhancing module 700, said reset enhancing module 800 all contain transistors; moreover, the respective transistors contained in the shift register are all N-type transistors. The control terminal of each module corresponds to the gate of the transistor, the input terminal corresponds to the source of the transistor, the output terminal corresponds to the drain of the transistor, here the first electrical level is a high electrical level, and the second electrical level is a low electrical level.

The benefit of doing so is that the same process can be used for fabrication, which reduces the complexity of fabricating the corresponding display panel. Certainly, in actual applications, the similar effect can also be achieved by replacing part or all of the transistors therein with P-type transistors, the corresponding technical solution should also fall within the protection scope of the present disclosure.

In specific implementation, said energy storage module 300 may be a capacitor specifically, or other elements with the energy storage function. The second terminal of the energy storage module 300 may also be connected with the shift signal output terminal OUTPUT.

In specific implementation, the first electrical level input terminal S2 here may input the first electrical level only when the output module needs to output the pulse of the first electrical level.

Figure 5:
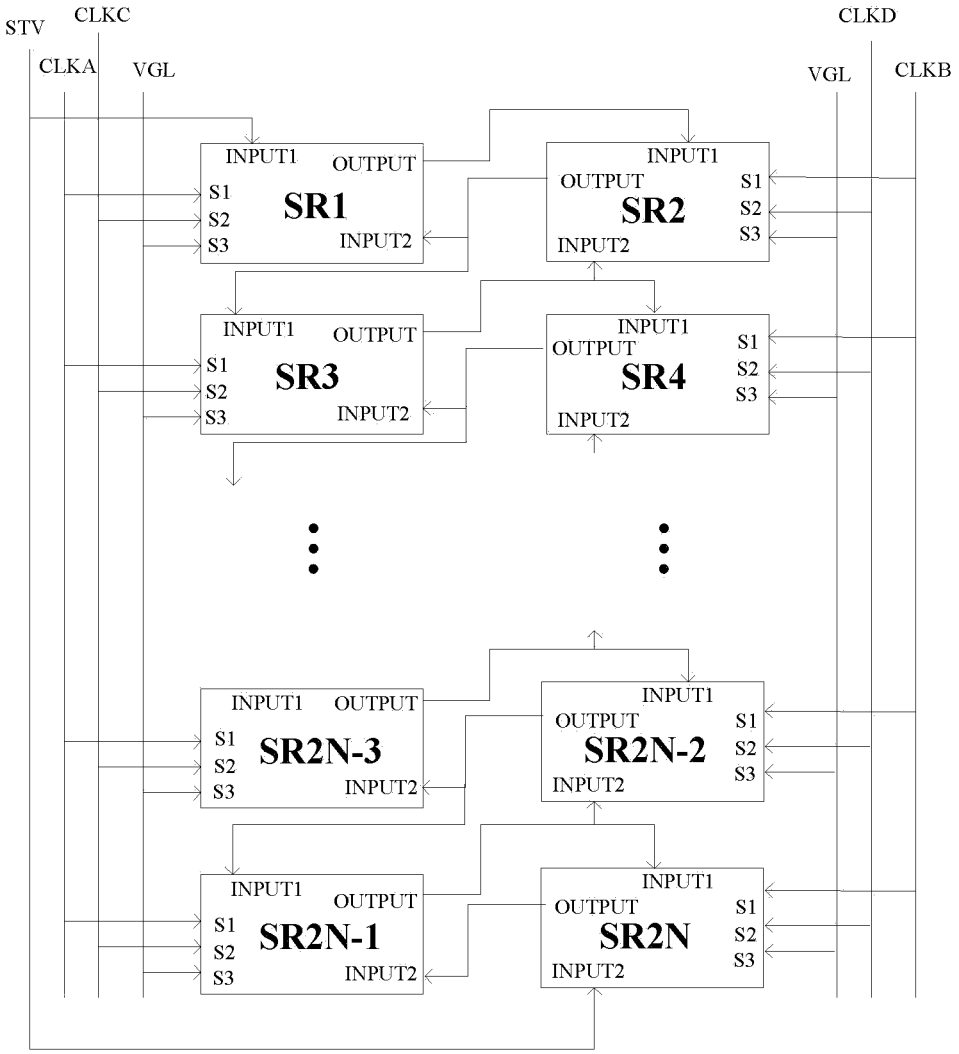
FIG. 5 is a structural schematic view of a bidirectional scanning circuit provided by an embodiment of the present disclosure.

In the second aspect, the present disclosure further provides a gate driving circuit, as shown in FIG. 5, the gate driving circuit comprising 2N shift registers as shown in FIG. 3, as well as a first signal line STV, a second signal line CLKA and a third signal line CLKB; wherein a first shift signal input terminal INPUT1 of a first stage of shift register SR1 and a second shift signal input terminal INPUT2 of a last stage of shift register SR2N are connected with the first signal line STV. Reset control signal input terminals S1 of odd stages of shift registers are connected with the second signal line CLKA, and reset control signal input terminals S1 of even stages of shift registers are connected with the third signal line CLKB. A shift signal output terminal OUTPUT of any stage of shift registers except for the first stage and the last stage is connected with a second shift signal input terminal INPUT2 of a previous stage of shift register and a first shift signal input terminal INPUT1 of a next stage of shift register.

It should be noted that, although the gate driving circuit shown in FIG. 5 is illustrated as comprising an even number of shift registers, the gate driving circuit may comprise an odd number of shift registers as well.

In addition, the shift signal output terminal OUTPUT of the first stage of shift register SR1 is connected with the first shift signal input terminal INPUT1 of the second stage of shift register SR2, the shift signal output terminal OUTPUT of the last stage of shift register SR2N is connected with the second shift signal input terminal INPUT2 of the last second stage of shift register SR2N−1.

In specific implementation, the first electrical level input terminal S2 of each odd stage of shift registers may are connected with a fourth signal line CLKC, and the first electrical level input terminal S2 of each even stages of shift registers may are connected with a fifth signal line CLKD. Here the first electrical level can be provided for the first electrical level input terminal S2 of each shift register through the signal lines CLKC and CLKD.

In addition, said gate driving circuit further comprises a voltage line VGL, the voltage line VGL being connected with the second electrical level input terminal S3 of each shift register.

Moreover, in specific implementation, if said shift register further comprises a reset enhancing module 800 and a reset enhancing control signal input terminal S4, the reset enhancing module control terminal S4 of any stage of shift registers except for the first stage and the last stage is connected with the first signal line STV (not shown in the figure), and the turn-on electrical level of each reset enhancing module 800 is the first electrical level. In this way, the start pulse applied by the first signal line can be introduced before the start of a frame to perform enhanced reset to all the PU points in the respective shift registers except for the first stage and the last stage.

Also referring to FIG. 5, the present disclosure further provides a display panel, wherein the shift registers for driving odd rows of pixels in the gate driving circuit of the display panel are located at the left side of the display area, and the shift registers for driving even rows of pixels are located at the right side of the display area; the signal lines CLKA and CLKC for being connected with odd stages of shift registers are located at the left side of the shift registers, and the signal lines CLKB and CLKD for being connected with even stages of shift registers are located at the right side of the shift registers. Here, there are also two voltage lines VGL, which are located at left and right sides of the display area respectively; the left side voltage line VGL being connected with the second electrical level input terminal S3 of odd stages of the shift registers, the right side voltage line VGL being connected with the second electrical level input terminal S3 of the even stages of shift registers.

Arranging the respective shift registers of the gate driving circuit at the left and right sides of the display area, as compared to arranging them at the same side, can make the widths of the frames of the two sides consistent, which reduces the width of the single side frame, and is favorable for narrowing down the frame.

A method for driving a gate driving circuit can be used for driving the gate driving circuit as shown in FIG. 5. The method comprises:

in forward scanning, applying a start pulse with a first electrical level on the first signal line STV, applying a clock signal on the second signal line CLKA and the third signal line CLKB respectively; wherein the reset pulse capable of turning on the reset module in the clock signal applied on the third signal line CLKB is delayed a half pulse from the reset pulse in the clock signal applied on the second signal line CLKA; the start pulse is delayed a half pulse from the reset pulse in the clock signal applied on the second signal line CLKA;

in backward scanning, applying a start pulse with a first electrical level on the first signal line STV, applying a clock signal on the second signal line CLKA and the third signal line CLKB respectively; wherein the reset pulse in the clock signal applied on the second signal line CLKA is delayed a half pulse from the reset pulse in the clock signal applied on the third signal line CLKB; the start pulse is delayed a half pulse from the reset pulse in the clock signal applied on the third signal line CLKB.

The gate driving method provided above can make the shift registers as shown in FIG. 5 to perform forward scanning or backward scanning correctly without arranging the VSS and VDD voltage lines.

Figure 6:
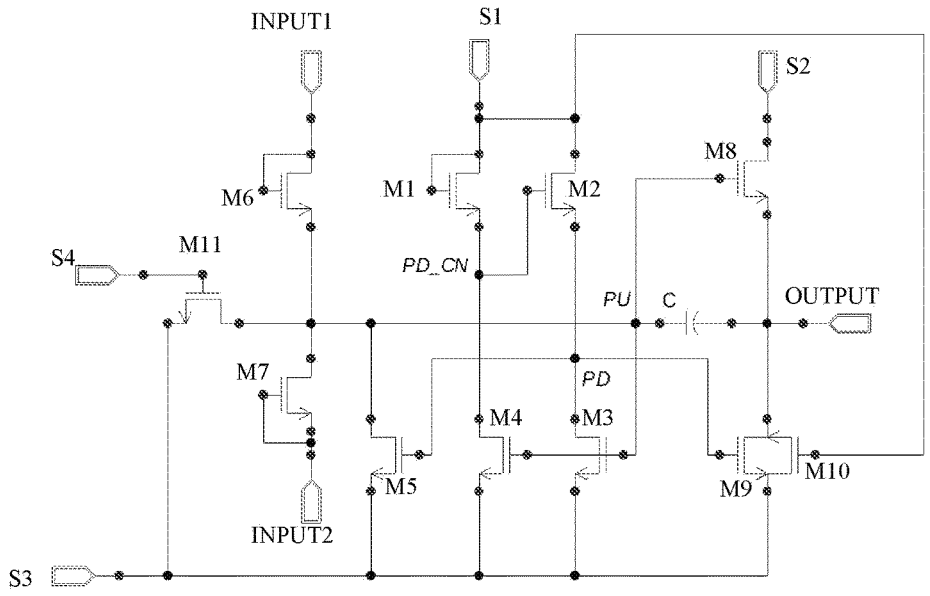
FIG. 6 is a circuit structure diagram of a shift register provided by an embodiment of the present disclosure.

Next, a specific circuit structure is combined to explain the gate driving circuit and the driving method thereof in detail. As shown in FIG. 6, it is a structural schematic view of one stage of shift registers in the gate driving circuit in FIG. 5, comprising: totally 11 N-type transistors M1-M11 and a capacitor C; wherein M1-M5 constitute a reset circuit as shown in FIG. 4, and its structure and connection relation are consistent as FIG. 4, which will not be explained specifically here. The transistor M6 constitutes the first input module, and its source and gate are connected with the first shift signal input terminal INPUT1, the drain is connected with the first node PU; the transistor M7 constitutes the second input module, and its source and gate are connected with the second shift signal input terminal INPUT2, the drain is connected with the first node PU; the transistor M8 constitutes the output module, and its gate is connected with the first node PU, the source is connected with the first electrical level input terminal S2, the drain is connected with the shift signal output terminal OUTPUT; the transistor M9 constitutes the unset module, and the transistor M10 constitutes the unset enhancing module, wherein the sources of the two transistors are both connected with the shift signal output terminal OUTPUT, the drains are both connected with the second electrical level input terminal S3, the gate of the transistor M9 is connected with the third node PD, the gate of the transistor M10 is connected with the reset control signal input terminal S1; the transistor 11 constitutes the reset enhancing module, its gate is connected with the reset enhancing control signal input terminal S4, the source is connected with the first node PU, the drain is connected with the second electrical level input terminal S3.

Figure 7A:
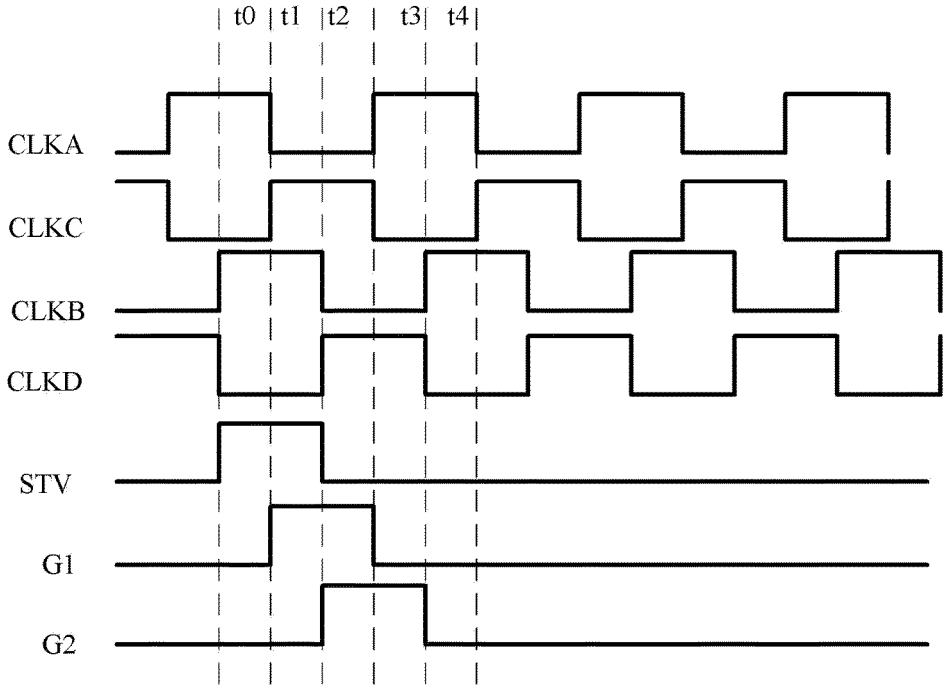
FIG. 7*a* is a timing diagram of key signals in forward scanning when the bidirectional scanning circuit in FIG. 5 comprises a shift register as shown in FIG. 6.

Here, the forward scanning and backward scanning of the corresponding gate driving circuit can be realized by applying corresponding voltages on the signal lines connected by said respective input terminals. As shown in FIG. 7*a*, it is a timing diagram of several key signals when performing forward scanning using the gate driving circuit as shown in FIG. 6.

As shown in FIG. 7*a*, clock signals are applied on the signal lines CLKA, CLKB, CLKC, CLKD, wherein the phase of the clock signal applied on the signal line CLKA is opposite to the phase of the clock signal applied on the signal line CLKB; the phase of the clock signal applied on the signal line CLKC is opposite to the phase of the clock signal applied on the signal line CLKD; moreover, the high electrical level pulse in the clock signal applied on the signal line CLKB is delayed a half pulse from the high electrical level pulse in the clock signal applied on the signal line CLKA; and a start high electrical level pulse is applied on the signal line STV, the start high electrical level pulse coinciding with the first high electrical level pulse of the signal line CLKB, and is also delayed a half pulse from the high electrical level pulse in the clock signal applied on the signal line CLKA.

Referring to FIG. 7*a*, for the first stage of shift register SR1, the start high electrical level pulse inputted at its first shift signal input terminal INPUT1 is delayed a half pulse from the first high electrical level pulse on the signal line CLKA, thus, within a time (represented as t1 in the figure) of half a pulse after the end of the first high electrical level pulse on the signal line CLKA, the signal terminal S1 that is connected with the signal line CLKA is at a low electrical level, such that the transistors M1, M2, M5 in the first stage of register SR1 cannot be turned on, while the start signal STV turns on the transistor M6, and charges the first node PU, so as to pull up the first node PU, thereby resulting in turn-on of the transistor M8, and since the signal line CLKC that is connected with the first electrical level input terminal S2 is at a high electrical level within both the phase of t1 and half a pulse after the phase of t1 (phase of t2 as shown in the figure), the shift signal output terminal OUTPUT outputs a high electrical level pulse G1 in the phase of t1 and the phase of t2. In the phase of t3, the electrical level on the signal line CLKA is high, such that the transistors M1, M2, M5 are turned on, the first node PU is reset such that the electrical level of the first node PU is set to a low electrical level, the transistor M8 is turned off, here the OUTPUT will not output the high electrical level any more, and the transistors M9 and M10 are also turned on, ensuring that the shift signal output terminal OUTPUT will not output the high electrical level any more.

And for the last stage of shift register SR2N, at the phase of t1 and the phase of t0 before the phase of t1, since the signal line CLKB connected by its signal input terminal S1 is at a high electrical level, the charges inputted to its first node PU via its second shift signal input terminal INPUT2 are released by the transistor M5, thus the first node PU will not be set to a high electrical level. In this way, its shift signal output terminal OUTPUT will also be unable to output the high pulse, accordingly, the backward scanning will not be realized.

For the second stage of shift register SR2, at the phase of t1, since the CLKB accessed by the signal input terminal S1 is at a high electrical level, such that the transistor M5 is turned on, the first node PU cannot be charged. At the phase of t2, the CLKB accessed by the signal input terminal S1 is at a low electrical level, such that the transistor M5 is turned off, while the shift signal G1 accessed by its first shift signal input terminal INPUT is at a high electrical level, the first node PU can be charged; since the signal line CLKD accessed by its first electrical level input terminal S2 is at a high electrical level at both the phase of t2 and the phase of t3, the shift signal output terminal OUTPUT outputs a high electrical level pulse G2 at both the phase of t2 and the phase of t3. At the phase of t4 after the phase of t3, the first node PU is reset to a low electrical level, and the shift signal output terminal OUTPUT is unset to a low electrical level.

Also referring to FIG. 7*a*, at the phase of t2, for the shift register SR1, the input terminal of its shift signal input terminal INPUT2 accesses the high electrical level pulse G2, such that the transistor M7 is turned on. In this way, even if certain leakage occurs to the transistors M1 and M5, the first node PU is stilled maintained at a high electrical level, thereby not influencing output of the high electrical level pulse G1. At the phase of t3, although the input terminal of the second shift signal input terminal INPUT2 still accesses the high electrical level pulse G2, due to turn-on of the transistor M5, the charges D charged by it to the first node PU will also be released via the transistor M5, such that the first node PU will not be maintained at the high electrical level, ensuring the reset of the first node.

Correspondingly, for the third shift register and the subsequent stages of shift registers, the timing relationship of the respective signals accessed by them is completely consistent with the timing relationship of the respective signals accessed by the first stage of shift register SR1 and the second stage of shift register SR2, which can accomplish the corresponding output and reset. Thus the forward scanning of the gate driving circuit can be realized.

Figure 7B:
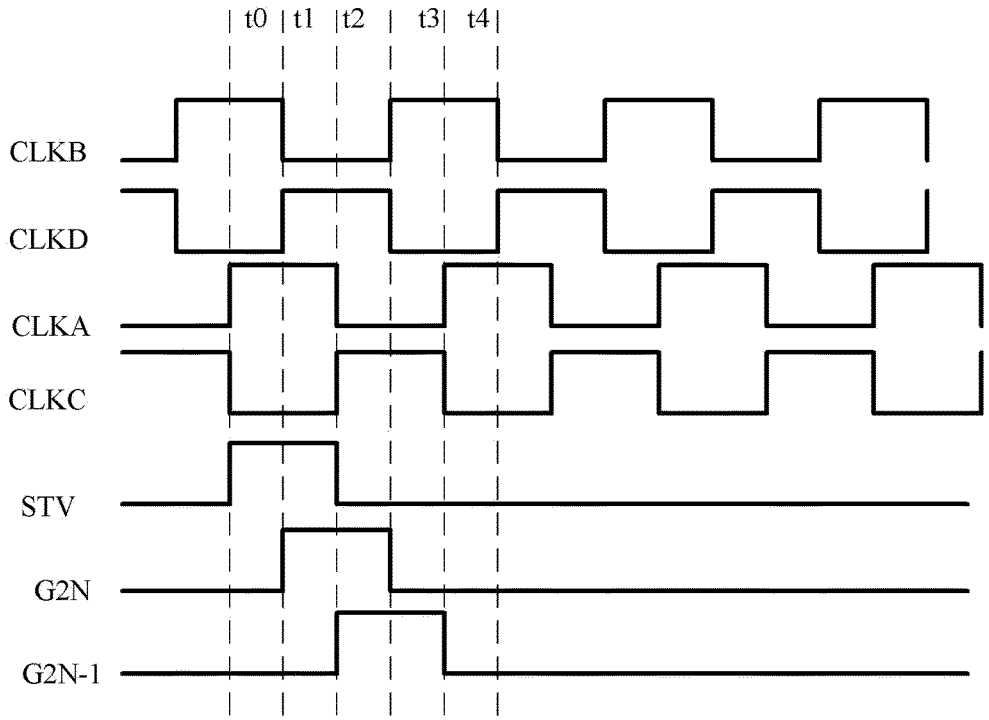
FIG. 7*b* is a timing diagram of key signals in backward scanning when the bidirectional scanning circuit in FIG. 5 comprises a shift register as shown in FIG. 6.

As shown in FIG. 7*b*, it is a timing diagram of several key signals when performing backward scanning using the gate driving circuit as shown in FIG. 6.

As shown in FIG. 7*b*, clock signals are also applied on the signal lines CLKA, CLKB, CLKC, CLKD, wherein the phase of the clock signal applied on the signal line CLKA is opposite to the phase of the clock signal applied on the signal line CLKB; the phase of the clock signal applied on the signal line CLKC is opposite to the phase of the clock signal applied on the signal line CLKD; what is different from the timing diagram as shown in FIG. 7*a* is that the high electrical level pulse in the clock signal applied on the signal line CLKB is half a pulse ahead of the high electrical level pulse in the clock signal applied on the signal line CLKA; and a start high electrical level pulse is applied on the signal line STV, the start high electrical level pulse coinciding with the first high electrical level pulse of the signal line CLKA. The specific working principle thereof may refer to the above process of forward scanning, which will not be explained specifically here.

During the driving process as stated in FIG. 7*b*, the (2N)th stage of shift register SR2N turns on firstly, and outputs a shift pulse G2N, the (2N−1)th stage of shift register SR2N−1 outputs a shift pulse G2N−1 based on the shift pulse G2N.

To sum up, it can be seen that since the CLKA and CLKB can realize reset of the first node PU timely, even if a high electrical level is applied on the CLKC and CLKD all the time, the output and reset of the corresponding shift register will not be influence either. The shift register provided by the present disclosure can make the corresponding gate driving circuit to perform forward scanning and backward scanning correctly without arranging VDD lines and VSS lines.

What are stated above are only the specific implementations of the present disclosure; however, the protection scope of the present disclosure is not limited to these, any variation or alternatives that can be easily conceived by the skilled person familiar with the technical field within the technical scope disclosed by the present disclosure should be covered within the protection scope of the present disclosure. Therefore, the protection scope of the present disclosure should be based on the protection scopes of the claims.

The invention claimed is:

1. A shift register, comprising: a first input module, a second input module, an energy storage module, an output module and a reset module; and two shift signal input terminals, a reset control signal input terminal, a second electrical level input terminal and a first electrical level input terminal;

a control terminal and an input terminal of the first input module being connected with a first shift signal input terminal, a control terminal and an input terminal of the second input module being connected with a second shift signal input terminal; output terminals of the first input module and the second input module as well as a first terminal of the energy storage module all being connected with a first node; the first input module and the second input module being configured to be turned on when the first or second shift signal input terminal accesses a first electrical level, and set the voltage of the first node to the first electrical level;

an output terminal of the reset module being connected with the first node, a control terminal of the reset module being connected with the reset control signal input terminal, an input terminal of the reset module being connected with the second electrical level input terminal, the reset module being configured to be turned on in response to a control signal accessed by the reset control signal input terminal, and set the voltage of the first node to a second electrical level capable of turning off the output module;

a control terminal of the output module being connected with the first node, an output terminal of the output module being connected with a shift signal output terminal, an input terminal of the output module being connected with the first electrical level input terminal, the output module being configured to be turned on when a voltage of the first node is the first electrical level, and output a shift signal of the first electrical level, wherein the reset module comprises: a first transistor, a second transistor, a third transistor, a fourth transistor and a fifth transistor; a first electrode and a gate of the first transistor are both connected with the reset control signal input terminal; a second electrode of the first transistor, a gate of the second transistor, and a first electrode of the fourth transistor are all connected with a second node; a second electrode of the second transistor, a first electrode of the third transistor, and a gate of the fifth transistor are all connected with third node, second electrodes of the third transistor, the fourth transistor and the fifth transistor are all connected with the second electrical level input terminal; a gate of the third transistor and a first electrode of the fifth transistor are both connected with the first node, and turn-on electrical levels of the respective transistors are consistent; a channel width to length ratio of the fourth transistor is smaller than a channel width to length ratio of the first transistor.

2. The shift register as claimed in claim 1, further comprising an unset module; an output terminal of the unset module being connected with the shift signal output terminal, an input terminal of the unset module being connected with the second electrical level input terminal, the unset module being configured to be turned on under the control of the control signal accessed by the control terminal, and set a voltage of the shift signal output terminal to the second electrical level.

3. The shift register as claimed in claim 1, wherein a control terminal of the unset module is connected with the third node, and the turn-on electrical level of the unset module is consistent with the turn-on electrical levels of the first transistor, the second transistor, the third transistor, the fourth transistor and the fifth transistor.

4. The shift register as claimed in claim 2, further comprising an unset enhancing module, a control terminal of the unset enhancing module being connected with the reset control signal input terminal, an output terminal of the unset enhancing module being connected with the shift signal output terminal, an input terminal of the unset enhancing module being connected with the second electrical level input terminal, the unset enhancing module being configured to be turned on when the reset module is turned on, and set a voltage of the shift signal output terminal to the second electrical level.

5. The shift register as claimed in claim 2 further comprising: a reset enhancing module and a reset enhancing control signal input terminal, an output terminal of the reset enhancing module being connected with the first node, an input terminal of the reset enhancing module being connected with the second electrical level input terminal, a control terminal of the reset enhancing module being connected with the reset enhancing control signal input terminal, the reset enhancing module being configured to be turned on under the control of the control signal accessed by the reset enhancing control signal input terminal, and set a voltage of the first node to the second electrical level.

6. The shift register as claimed in claim 1 further comprising: a reset enhancing module and a reset enhancing control signal input terminal, an output terminal of the reset enhancing module being connected with the first node, an input terminal of the reset enhancing module being connected with the second electrical level input terminal, a control terminal of the reset enhancing module being connected with the reset enhancing control signal input terminal, the reset enhancing module being configured to be turned on under the control of the control signal accessed by the reset enhancing control signal input terminal, and set a voltage of the first node to the second electrical level.

7. The shift register as claimed in claim 3 further comprising: a reset enhancing module and a reset enhancing control signal input terminal, an output terminal of the reset enhancing module being connected with the first node, an input terminal of the reset enhancing module being connected with the second electrical level input terminal, a control terminal of the reset enhancing module being connected with the reset enhancing control signal input terminal, the reset enhancing module being configured to be turned on under the control of the control signal accessed by the reset enhancing control signal input terminal, and set a voltage of the first node to the second electrical level.

8. The shift register as claimed in claim 4, further comprising: a reset enhancing module and a reset enhancing control signal input terminal, an output terminal of the reset enhancing module being connected with the first node, an input terminal of the reset enhancing module being connected with the second electrical level input terminal, a control terminal of the reset enhancing module being connected with the reset enhancing control signal input terminal, the reset enhancing module being configured to be turned on under the control of the control signal accessed by the reset enhancing control signal input terminal, and set a voltage of the first node to the second electrical level.

9. The shift register as claimed in claim 5, wherein the first input module, the second input module, the output module, the reset enhancing module, the unset module and the unset enhancing module all contain transistors; and the transistors contained in the shift register are all N-type transistors.

10. A gate driving circuit, comprising a plurality of shift registers as claimed in claim 1, and further comprising: a first signal line, a second signal line, a third signal line;

wherein a first shift signal input terminal of a first stage of shift register and a second shift signal input terminal of a last stage of shift register are connected with the first signal line; reset control signal input terminals of odd stages of shift registers are connected with the second signal line, reset control signal input terminals of even stages of shift registers are connected with the third signal line;

a shift signal output terminal of any stage of shift registers except for the first stage and the last stage is connected with a second shift signal input terminal of a previous stage of shift register and a first shift signal input terminal of a next stage of shift register.

11. The gate driving circuit as claimed in claim 10, wherein, when any of the plurality of shift registers furthers comprising a reset enhancing module and a reset enhancing control signal input terminal, an output terminal of the reset enhancing module being connected with the first node, an input terminal of the reset enhancing module being connected with the second electrical level input terminal, a control terminal of the reset enhancing module being connected with the reset enhancing control signal input terminal, the reset enhancing module being configured to be turned on under the control of the control signal accessed by the reset enhancing control signal input terminal, and set a voltage of the first node to the second electrical level, a reset enhancing control signal input terminal of any stage of shift registers except for the first stage and the last stage is connected with the first signal line, and the turn-on electrical level of each reset enhancing module is the first electrical level.

12. A gate driving circuit, comprising a plurality of shift registers as claimed in claim 2, and further comprising: a first signal line, a second signal line, a third signal line;

wherein a first shift signal input terminal of a first stage of shift register and a second shift signal input terminal of a last stage of shift register are connected with the first signal line; reset control signal input terminals of odd stages of shift registers are connected with the second signal line, reset control signal input terminals of even stages of shift registers are connected with the third signal line;

a shift signal output terminal of any stage of shift registers except for the first stage and the last stage is connected with a second shift signal input terminal of a previous stage of shift register and a first shift signal input terminal of a next stage of shift register.

13. A gate driving circuit, comprising a plurality of shift registers as claimed in claim 3, and further comprising: a first signal line, a second signal line, a third signal line;

wherein a first shift signal input terminal of a first stage of shift register and a second shift signal input terminal of a last stage of shift register are connected with the first signal line; reset control signal input terminals of odd stages of shift registers are connected with the second signal line, reset control signal input terminals of even stages of shift registers are connected with the third signal line;

a shift signal output terminal of any stage of shift registers except for the first stage and the last stage is connected with a second shift signal input terminal of a previous stage of shift register and a first shift signal input terminal of a next stage of shift register.

14. A gate driving circuit, comprising a plurality of shift registers as claimed in claim 4, and further comprising: a first signal line, a second signal line, a third signal line;

wherein a first shift signal input terminal of a first stage of shift register and a second shift signal input terminal of a last stage of shift register are connected with the first signal line; reset control signal input terminals of odd stages of shift registers are connected with the second signal line, reset control signal input terminals of even stages of shift registers are connected with the third signal line;

a shift signal output terminal of any stage of shift registers except for the first stage and the last stage is connected with a second shift signal input terminal of a previous stage of shift register and a first shift signal input terminal of a next stage of shift register.

15. A display panel, comprising a gate driving circuit as claimed in claim 10, wherein the shift registers for driving odd rows of pixels are arranged at a first side of the display area, the shift registers for driving even rows of pixels are arranged at a second side of the display area, the first side and the second side are two opposite sides.

16. A display panel, comprising a gate driving circuit as claimed in claim 11, wherein the shift registers for driving odd rows of pixels are arranged at a first side of the display area, the shift registers for driving even rows of pixels are arranged at a second side of the display area, the first side and the second side are two opposite sides.

17. A method for driving a gate driving circuit as claimed in claim 10, comprising:

in forward scanning, applying a start pulse with a first electrical level on the first signal line, applying a clock signal on the second signal line and the third signal line respectively; wherein the reset pulse capable of turning on the reset module in the clock signal applied on the third signal line is delayed a half pulse from the reset pulse in the clock signal applied on the second signal line; the start pulse is delayed a half pulse from the reset pulse in the clock signal applied on the second signal line;

in backward scanning, applying a start pulse with a first electrical level on the first signal line, applying a clock signal on the second signal line and the third signal line respectively; wherein the reset pulse in the clock signal applied on the second signal line is delayed a half pulse from the reset pulse in the clock signal applied on the third signal line; the start pulse is delayed a half pulse from the reset pulse in the clock signal applied on the third signal line.

18. A method for driving a gate driving circuit as claimed in claim 11, comprising:

in forward scanning, applying a start pulse with a first electrical level on the first signal line, applying a clock signal on the second signal line and the third signal line respectively; wherein the reset pulse capable of turning on the reset module in the clock signal applied on the third signal line is delayed a half pulse from the reset pulse in the clock signal applied on the second signal line; the start pulse is delayed a half pulse from the reset pulse in the clock signal applied on the second signal line;

in backward scanning, applying a start pulse with a first electrical level on the first signal line, applying a clock signal on the second signal line and the third signal line respectively; wherein the reset pulse in the clock signal applied on the second signal line is delayed a half pulse from the reset pulse in the clock signal applied on the third signal line; the start pulse is delayed a half pulse from the reset pulse in the clock signal applied on the third signal line.

* * * * *